US009207038B2

(12) United States Patent
Gilley

(10) Patent No.: US 9,207,038 B2
(45) Date of Patent: Dec. 8, 2015

(54) AMMUNITION LOADING APPARATUS AND METHODS THEREOF

(76) Inventor: Ian Gilley, Cranston, RI (US)

( * ) Notice: Subject to any disclaimer, the term of this patent is extended or adjusted under 35 U.S.C. 154(b) by 688 days.

(21) Appl. No.: 13/425,787

(22) Filed: Mar. 21, 2012

(65) Prior Publication Data

US 2013/0247890 A1 Sep. 26, 2013

(51) Int. Cl.
*F41B 11/55* (2013.01)
*F41A 9/83* (2006.01)

(52) U.S. Cl.
CPC .. *F41B 11/55* (2013.01); *F41A 9/83* (2013.01)

(58) Field of Classification Search
CPC ..... F41B 11/52; F41B 11/50; F41B 11/54; F41B 11/55; F41B 11/62; F41B 11/89; F41B 11/681; F41B 7/006; F41A 9/61; F41A 9/63
USPC ..... 124/51.1; 42/49.01, 11
See application file for complete search history.

(56) References Cited

U.S. PATENT DOCUMENTS

| | | | | |
|---|---|---|---|---|
| 2,981,024 | A * | 4/1961 | Skoff | 42/87 |
| 3,105,611 | A * | 10/1963 | Conti | 221/248 |
| 3,263,664 | A | 8/1966 | Bauer et al. | |
| 4,020,974 | A | 5/1977 | Bauer et al. | |
| 4,291,483 | A | 9/1981 | Musgrave | |
| 4,296,874 | A | 10/1981 | Evans | |
| 4,322,907 | A | 4/1982 | Rowe | |
| 4,455,915 | A | 6/1984 | Ransom | |
| 4,564,125 | A | 1/1986 | Esslinger | |
| 4,730,728 | A | 3/1988 | Larkin | |
| 4,831,998 | A | 5/1989 | Maguire, III | |
| 4,949,868 | A | 8/1990 | Olson | |
| 4,967,723 | A | 11/1990 | Cutrell | |
| 5,755,055 | A | 5/1998 | Thompson et al. | |
| 6,055,975 | A | 5/2000 | Gallagher et al. | |
| 6,213,110 | B1 | 4/2001 | Christopher et al. | |
| 6,234,157 | B1 | 5/2001 | Parks | |
| 6,408,837 | B1 | 6/2002 | Johnson et al. | |
| 6,889,711 | B2 | 5/2005 | Vetoretti et al. | |
| 7,275,530 | B2 | 10/2007 | Deak | |
| 7,568,478 | B2 | 8/2009 | Hedberg | |
| 7,591,260 | B1 | 9/2009 | Mu | |
| 7,640,924 | B2 | 1/2010 | Cherepanov | |
| 7,765,997 | B2 | 8/2010 | Klockener et al. | |
| 7,954,480 | B2 | 6/2011 | Broberg, Jr. | |
| 8,118,016 | B2 | 2/2012 | Italia et al. | |
| 2002/0104524 | A1 | 8/2002 | Reible | |
| 2006/0042613 | A1 | 3/2006 | Hu | |
| 2006/0102160 | A1 | 5/2006 | Zambito et al. | |
| 2006/0191523 | A1 | 8/2006 | Paletz et al. | |
| 2008/0047535 | A1 | 2/2008 | Handel | |
| 2010/0000505 | A1 | 1/2010 | Yeh | |

* cited by examiner

*Primary Examiner* — Melba Bumgarner
*Assistant Examiner* — Amir Klayman
(74) *Attorney, Agent, or Firm* — Hayes Soloway PC

(57) ABSTRACT

An ammunition loading apparatus and associated methods is provided. The ammunition loading apparatus include a storage compartment. A preload chamber is connected to the storage compartment. A load tube is sized to receive a quantity of ammunition within an interior ammunition passageway, the load tube having a first end and a second end, wherein the first end is connected to the preload chamber. A magazine is removably connectable to the second end of the load tube. A pump device is movable along at least a portion of a length of the load tube. A load pin is connected to the pump device and is movably controlled by the pump device along the portion of the length of the load tube, wherein the load pin is further movable between at least a first position intersecting the interior ammunition passageway and a second position not intersecting the interior ammunition passageway.

20 Claims, 8 Drawing Sheets

AMMUNITION LOADING APPARATUS AND METHODS THEREOF

FIELD OF THE DISCLOSURE

The present disclosure is generally related to ammunition loading and more particularly is related to an ammunition loading apparatus and methods thereof.

BACKGROUND OF THE DISCLOSURE

Imitation firearms using non-lethal ammunition are widely used for recreational and training purposes today. These firearms utilize compressed air to discharge pellet-based ammunition from the barrel of the firearm when a trigger is activated. The compressed air forces the ammunition down the barrel of the firearm and towards a target. These firearms retrieve their ammunition from magazines, which must be filled with ammunition before each use of the firearm. There are devices within the industry that assist with loading the ammunition into the magazine; however these devices are often expensive, inefficient, time-consuming, and cumbersome to use.

For instance, conventional ammunition loading devices often experience frequent malfunctioning, such as jamming of ammunition rounds in tight spaces. This jamming of ammunition rounds extends the time and effort needed to reload a magazine, which proves to be inefficient when compounded by the vast number of ammunition rounds needed to be loaded into a magazine. Another problem with conventional systems is the waste that occurs when transitioning between magazines during a loading process. Often, after a magazine is full of ammunition, a few remaining rounds remain at the junction between the magazine and the refilling device. Then the full magazine is removed, the remaining ammunition falls to the ground, thus resulting in wasted ammunition. Over an extended period of time, the wasted ammunition becomes a significant inefficiency in the cost of using the firearm.

Thus, a heretofore unaddressed need exists in the industry to address the aforementioned deficiencies and inadequacies.

SUMMARY OF THE DISCLOSURE

Embodiments of the present disclosure provide an ammunition loading apparatus and associated methods thereof. Briefly described, in architecture, one embodiment of the apparatus, among others, can be implemented as follows. The ammunition loading apparatus includes a storage compartment. A preload chamber is connected to the storage compartment. A load tube is sized to receive a quantity of ammunition within an interior ammunition passageway, the load tube having a first end and a second end, wherein the first end is connected to the preload chamber. A magazine is removably connectable to the second end of the load tube. A pump device is movable along at least a portion of a length of the load tube. A load pin is connected to the pump device and movably controlled by the pump device along the portion of the length of the load tube, wherein the load pin is further movable between at least a first position intersecting the interior ammunition passageway and a second position not intersecting the interior ammunition passageway.

The present disclosure can also be viewed as providing an apparatus for loading a quantity of spherically-shaped ammunition into a magazine. Briefly described, in architecture, one embodiment of the apparatus, among others, can be implemented as follows. The apparatus includes an ammunition holding chamber. A load tube is connected between the ammunition holding chamber and the magazine, wherein an elongated slot is formed within at least a portion of the load tube, and wherein the load tube sized to house the quantity of spherically-shaped ammunition in a linear configuration. A loading device has a pump handle and a load pin, wherein the loading device is movable along at least a portion of a length of the load tube with the load pin positioned within the elongated slot, wherein movement of the load pin within the elongated slot controls a movement of the quantity of spherically-shaped ammunition through the load tube and into the magazine.

The present disclosure can also be viewed as providing methods of loading a magazine with ammunition. In this regard, one embodiment of such a method, among others, can be broadly summarized by the following steps: placing a quantity of ammunition within an ammunition holding chamber of an ammunition loading device; moving at least a portion of the quantity of ammunition from the ammunition holding chamber to a preload chamber; disengaging a load pin positioned between the preload chamber and a load tube, thereby exposing an interior ammunition passageway within the load tube; engaging the load pin after the portion of the quantity of ammunition is positioned within the load tube, thereby closing the interior ammunition passageway; and moving the load pin to push the portion of the quantity of ammunition through the load tube towards the magazine, wherein at least part of the portion of the quantity of ammunition is loaded into the magazine.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
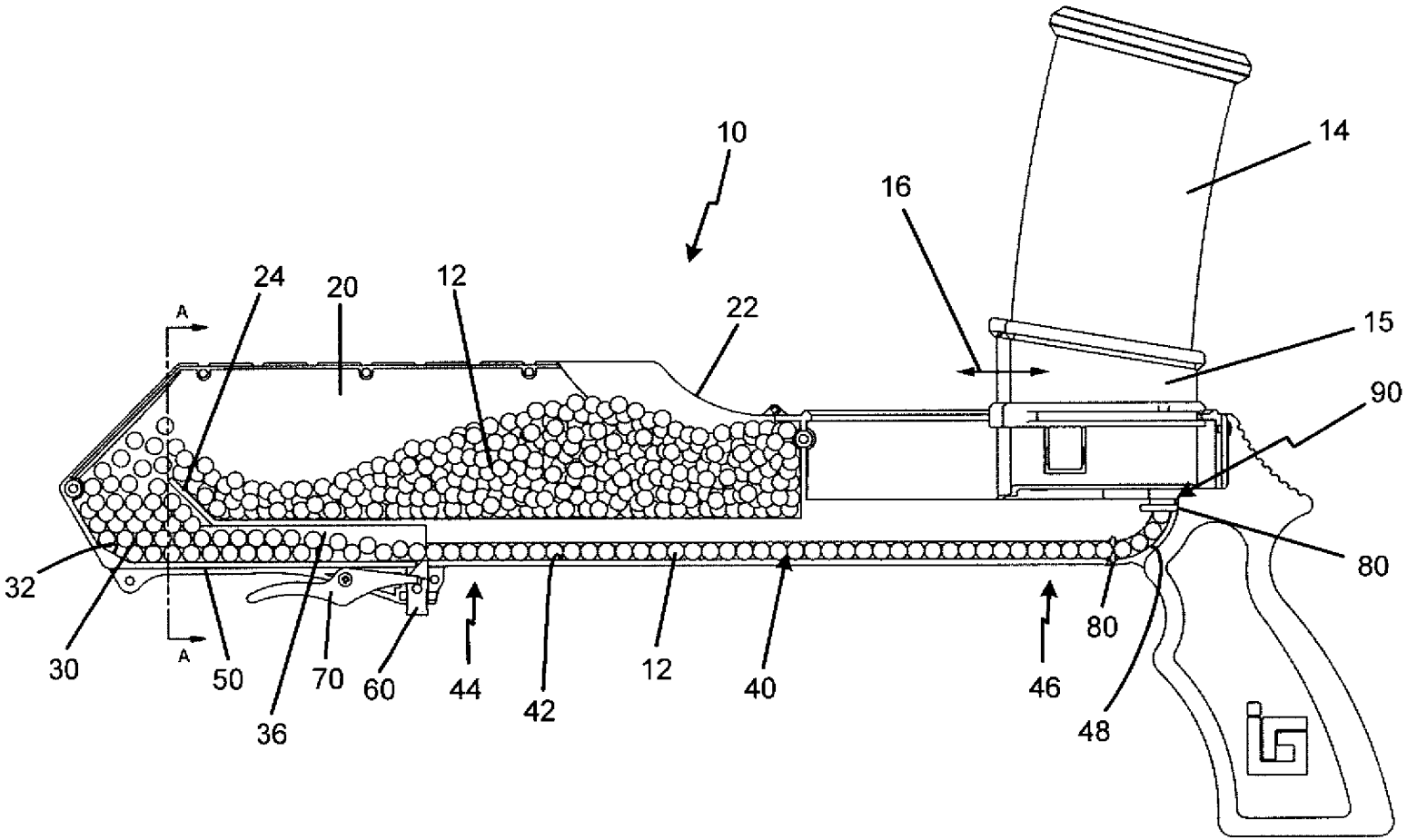
FIG. 1 is a cross-sectional illustration of an ammunition loading apparatus, in accordance with a first exemplary embodiment of the present disclosure.

FIG. 1 is a cross-sectional illustration of an ammunition loading apparatus 10, in accordance with a first exemplary embodiment of the present disclosure. The ammunition loading apparatus 10, which may be referred to herein simply as 'apparatus 10' includes a storage compartment 20. A preload chamber 30 is connected to the storage compartment 20. A load tube 40 is sized to receive a quantity of ammunition 12 within an interior ammunition passageway 42 of the load tube 40. The load tube 40 has a first end 44 and a second end 46, wherein the first end 44 is connected to the preload chamber 30. A magazine 14 is removably connectable to the second end 46 of the load tube 40. A pump device 50 is movable along at least a portion of a length of the load tube 40. A load pin 60 is connected to the pump device 50 and movably controlled by the pump device 50 along the portion of the length of the load tube 40. The load pin 60 is further movable between at least a first position intersecting the interior ammunition passageway 42 and a second position not intersecting the interior ammunition passageway 42.

The apparatus 10 may be used for loading ammunition within magazines used in firearms, and more preferably, within imitation firearms that utilize non-lethal ammunition. Within the industry, these types of imitation firearms may be known as Airsoft or AEG (Automatic Electric Gun), which utilize ammunition 12 that is non-metallic, non-lethal, and generally formed into spherical pellets constructed from plastics. This ammunition 12 may also be known within the industry as BBs' or 'rounds.' These imitation firearms may include a variety of different types of guns, such as rifles and handguns, each of which receives the ammunition 12 from a magazine 14 removably engagable with the firearm. The apparatus 10 may be functional with any type of magazine 14, and the use of a magazine adapter 15 between the magazine 14 and the apparatus 10 may be required.

As is shown in FIG. 1, a magazine adapter 15 may be used to removably connect the magazine 14 to the apparatus. A variety of different magazine adapters 15 may be used to connect a variety of different magazines 14 to the apparatus 10, such that a user may purchase the specific magazine adapter 15 needed to utilize the apparatus 10 with the particular magazine 14 the user owns. For example, some magazine adapters 15 include a SIG Mag Adapter, a G36 Mag Adapter, a SCAR Mag Adapter, a M4 Mag Adapter, a M4P Mag Adapter, a MP5 Mag Adapter, and a AK47 Mag Adapter, as well as others. When a magazine adapter 15 is used, it may be lowered into a magazine chamber of the apparatus 10, which is positioned behind the storage compartment 20. The magazine adapter 15 may have grooves on either side of the structure that engage with structures within the apparatus 10, such as rails (not shown) that are positioned within magazine chamber. To lock the magazine adapter 15 in place within the apparatus 10, the magazine adapter 15 may then be biased or moved rearward, toward the back of the apparatus 10 and away from the storage compartment, as is identified by arrow 16 in FIG. 1. A detent or other structure may secure the magazine adapter 15 in place within the apparatus 10, while flexible catches within the magazine adapter 15 may secure the magazine 14 thereto, such that the magazine 14 is in a positioned on the apparatus 10 to be loaded with ammunition 12.

The storage compartment 20 may be sized to receive a large quantity of ammunition 12, such as 2,000 or more rounds of ammunition 12. The storage compartment 20 may have a lid 22 which is movably affixed to the storage compartment 20, such as with a hinge, a screw-on cap, or similar structure, and controls access to the interior of the storage compartment 20. The lid 22 may be see-through, such that a user can monitor the capacity of the ammunition 12 within the storage compartment 10. In use, a user may move the lid 22 to access the storage compartment 20 and load a quantity of ammunition 12 therein. The storage compartment 20 is connected to a preload chamber 30, which is characterized as a space for receiving a portion of the quantity of ammunition 12 from the storage compartment 20, such that the received portion of the ammunition 12 is staged for eventual loading into the magazine 14.

It is important for a large quantity of ammunition 12 to be pared down before loading into a magazine 14, since jamming and malfunctioning can occur when loading a large quantity of ammunition 12. Accordingly, separating away a portion of the quantity of ammunition 12 within the storage compartment 20 may provide consistent and efficient loading of the ammunition 12 into the magazine 14, with a lesser chance of malfunctioning. For example, if 2,000 rounds of ammunition 12 are placed within the storage compartment 20, approximately 50 rounds of ammunition 12 may be moved to the preload chamber 30 at a given time. These 50 rounds of ammunition 12 may be manageably configured or positioned such that they can be input into the load tube 40 for eventual magazine loading. In addition to the quantity of ammunition 12 that is staged for loading into the magazine 14, the orientation of the individual rounds of ammunition 12 together as a group may be an important factor in efficient loading with the apparatus 10, as is discussed further with respect to FIG. 2.

Commonly, the preload chamber 30 will be integrally formed with the storage compartment 20, such that the preload chamber 30 is at least partially open to the storage compartment 20. This configuration may allow for easy movement of a portion of the ammunition 12 within the storage compartment 20 into the preload chamber 30. It may be preferable for the preload chamber 30 to be positioned relatively lower than the storage compartment 20, when the apparatus 10 is in a standard orientation, as shown in FIG. 1. As is shown in FIG. 1, the preload chamber 30 may be open to the storage compartment 20, but separated from the storage compartment with a baffle 24. The baffle 24, which may also be referred to as an ammunition ramp, may be an angled structure that inhibits ammunition 12 from moving into the preload chamber 30 without provocation. In use, the apparatus 10 may be rocked back and forth to raise and lower the relative positioning of the storage chamber 20 with respect to the preload chamber 30. This movement may provoke a portion of the quantity of ammunition 12 within the storage compartment 20 to contact and pass over the baffle 24, and move into the preload chamber 30. This ability of the apparatus 10 may allow a user to repeatedly position a manageable quantity of ammunition 12 for movement through the load tube 30 and into the magazine 14.

Figure 2:
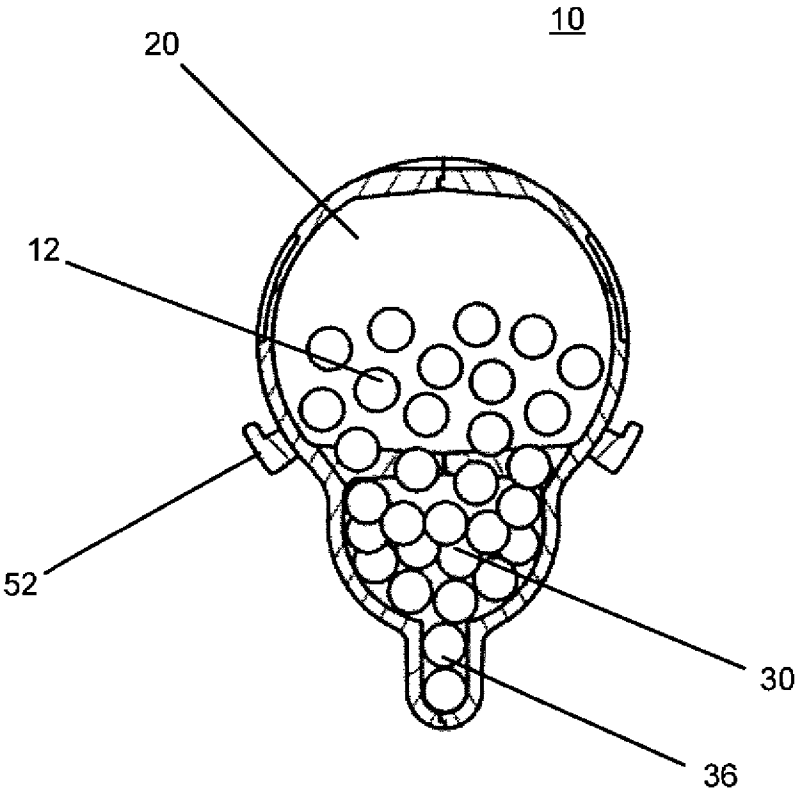
FIG. 2 is a cross-sectional illustration along the line A-A of the ammunition loading apparatus of FIG. 1, in accordance with the first exemplary embodiment of the present disclosure.

It is noted that any number of baffles 24, ramps 32, or other structures may be included to assist with successful and efficient ammunition movement throughout the storage compartment 20 or preload chamber 30. Likewise, the apparatus 10 may include any number, any size, or any type of preload chambers 30. For example, a plurality of successive preload chambers 30 may be used to further pare down a select quantity of ammunition 12 for loading into the magazine 14. In another example, the preload chamber 30 may further comprise a stacking chamber 36, which is integrally formed within and beyond the preload chamber 30, such as a trough structure within the base of the preload chamber 30. The stacking chamber 36, which is best depicted in FIG. 2, may receive a portion of the ammunition 12 within the lower portion of the preload chamber 30, and position it for insertion into the load tube 40. Preferably, the stacking chamber 36 is sized to receive the rounds of ammunition 12 in a configuration where the rounds are no more than one round wide and no more than two rounds high, as is shown in FIGS. 1-2. This configuration allows the stacking chamber 36 to become isolated from the preload chamber 30 and the storage compartment 20, such that interference between the ammunition 12 rounds is prevented, which allows the ammunition 12 rounds to relax and form a single row before entering the load tube 40.

Naturally, the quantity of ammunition 12 within the stacking chamber 36 may be less than the quantity of ammunition 12 within the preload chamber 30, to further provide efficient and manageable movement of the ammunition 12 into the load tube 40. The stacking chamber 36 is described further with respect to FIG. 2.

The quantity of ammunition 12 within the preload chamber 30, or the stacking chamber 36, as the case may be, is delivered to the magazine 14 via the load tube 40. The load tube 40 may be an elongated structure having an interior space that forms the interior ammunition passageway 42, which may be referred to simply as 'ammunition passageway 42,' through which the ammunition 12 travels. It is noted that the ammunition passageway 42 may be characterized as extending beyond the first end 44 of the load tube 40, and into the preload chamber 30 into areas of the preload chamber 30 where ammunition 12 may be located or moved through. The load tube 40 may be a substantially cylindrical structure with an elongated slit formed therein, which allows the load pin 60 to move along the length of the load tube 40 while at least partially within the ammunition passageway 42. Additionally, the load tube 40 may have a plurality of windows therein to allow a user to visually determine the quantity of ammunition 12 within the load tube 40. The load tube 40 has a first end 44 that is proximate to the preload chamber 30, and a second end 46, which is proximate to the magazine 14. An opening of the load tube 40 at the first end 44 may be connected to the preload chamber 30, or another compartment formed therein, such as the stacking chamber 36. A mouth 90 at the second end 46 of the load tube 40 may be removably connectable to the magazine 14.

Movement of the ammunition 12 from the preload chamber 30 into the load tube 40 may be controlled by the load pin 60. The load pin 60 is movable to intersect and not intersect with the ammunition passageway 42 of the load tube 40, i.e., to withdraw from the ammunition passageway 42 and allow ammunition 12 to travel into the load tube 40, or to intersect the ammunition passageway 42 and prevent ammunition 12 from moving into the load tube 40. The load pin 60 may be biased, with a spring or similar structure, to force the load pin 60 to have a natural position where it is intersecting the ammunition passageway 42. The load pin 60 will therefore intersect with the ammunition passageway 42 when the load pin 60 is not being used by a user of the apparatus 10. Accordingly, the load pin 60 may be disengaged by the user to remove the load pin 60 from an intersecting position with the ammunition passageway 42, thereby exposing the ammunition passageway 42 to the ammunition 12 within the preload chamber 30. After the ammunition 12 has moved into the ammunition passageway 42, the load pin 60 may then be engaged to allow the load pin 60 to move back into its natural position, intersecting the ammunition passageway 42. In accordance with this disclosure, disengaging the load pin 60 moves the load pin 60 into a non-intersecting position with the ammunition passageway 42, and engaging the load pin 60 allows the load pin 60 to move into its natural position intersecting the ammunition passageway 42.

As is shown in FIG. 1, the load pin 60 may be controlled by an actuatable trigger 70 which is connected to the load pin 60. When the trigger 70 is actuated it moves the load pin 60 between a position intersecting the ammunition passageway 42 and a position not intersecting the ammunition passageway 42. The user of the apparatus 10 may actuate the trigger 70, thereby controlling the load pin 60, to allow for the ammunition 12 to travel from the preload chamber 30 and into the load tube 40. For example, the user may actuate the trigger 70 to place the load pin 60 in the non-intersecting position with the ammunition passageway 42. Then, the user may orient the apparatus 10, such as by tilting the apparatus 10, to move the ammunition 12 into the load tube 40. Once the load tube 40 is filled with ammunition 12, the user may release the trigger 70, thereby placing the load pin 60 into the intersecting position with the ammunition passageway 42. Once the load pin 60 is in the intersecting position with the ammunition passageway 42, the ammunition 12 within the load tube 40 may be prevented from exiting the load tube 40 through the first end 44.

With the quantity of ammunition 12 within the load tube 40, the user may then initiate the pump device 50 to transfer the ammunition 12 from the load tube 40 into the magazine 14. The pump device 50 may be similar to cocking devices used with firearms to load a round into a chamber of the firearm, in that the pump device 50 may be moved along at least a portion of the length of the load tube 40. This movement of the pump device 50 translates into movement of the load pin 60 along the same portion of the length of the load tube 40. However, it is noted that movement of the load pin 60 between the intersecting and non-intersecting positions with the ammunition passageway 42 may be independent of the pump device 50. Accordingly, when the load pin 60 is intersecting with the ammunition passageway 42, moving the pump device 50 may move the ammunition 12 within the load tube 40 towards the second end 46, and eventually into the magazine 14. The pump device 50 may move along the apparatus 10 proximate to the load tube 40 via any structures of devices, such as a rail system integrally formed on the apparatus (shown in FIG. 2) that allows the pump device 50 to move a predetermined length along the load tube 40.

As the pump device 50 is moved along the load tube 40 towards the second end 46, the ammunition 12 within the ammunition passageway 42 is forced towards the mouth 90 of the load tube 40 at the second end 46. Through successive actuations of the trigger 70 to move ammunition 12 into the load tube 40, and the pump device 50 to move ammunition 12 through the ammunition passageway 42, the ammunition 12 may be transferred into a magazine 14 positioned at the mouth 90 of the second end 46 of the load tube 40. The load tube 40 may be designed to hold any quantity of ammunition 12, such as approximately 40 rounds of ammunition 12, as is shown in FIG. 1. Depending on the quantity of ammunition 12 within the load tube 40 and the capacity of the magazine 14, any number of cycles of actuating the trigger 70 and pump device 50 may be used to completely fill a magazine 14.

The apparatus 10 may further include at least one restrictive structure 80 located at the second end 46 of the load tube 40. The restrictive structure 80 is a structure that is sized to partially impede movement of the quantity of ammunition 12 beyond a predetermined position on the load tube 40 with friction between the restrictive structure 80 and the ammunition 12. For example, the restrictive structure 80 may include an O-ring and/or a feed nozzle, or any other structure that is capable of impeding movement of ammunition 12 within the ammunition passageway 42. The restrictive structure 80 may be a rubberized or plastic material that contacts the ammunition 12 as it is pushed therethrough, thereby applying friction to the ammunition 12 as it is moved. As one skilled in the art can see, the restrictive structure 80 may prevent the ammunition 12 from passing therethrough without an external force being applied to the ammunition 12, such as a force from the pump device 50 moving the load pin 60.

Figure 5:
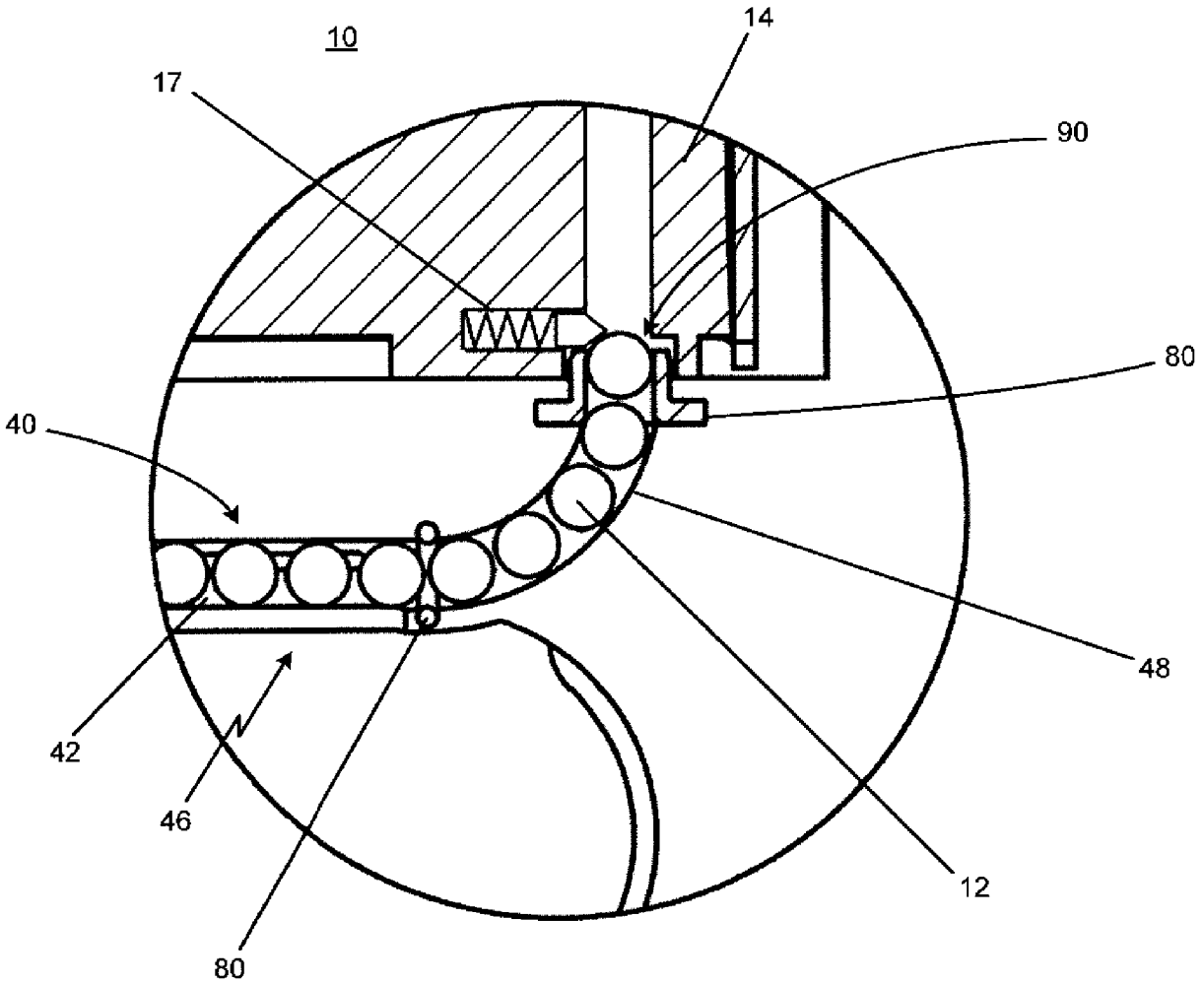
FIG. 5 is a cross-sectional illustration of the second end of the load tube of the ammunition loading apparatus of FIG. 1, in accordance with the first exemplary embodiment of the present disclosure.
Figure 6:
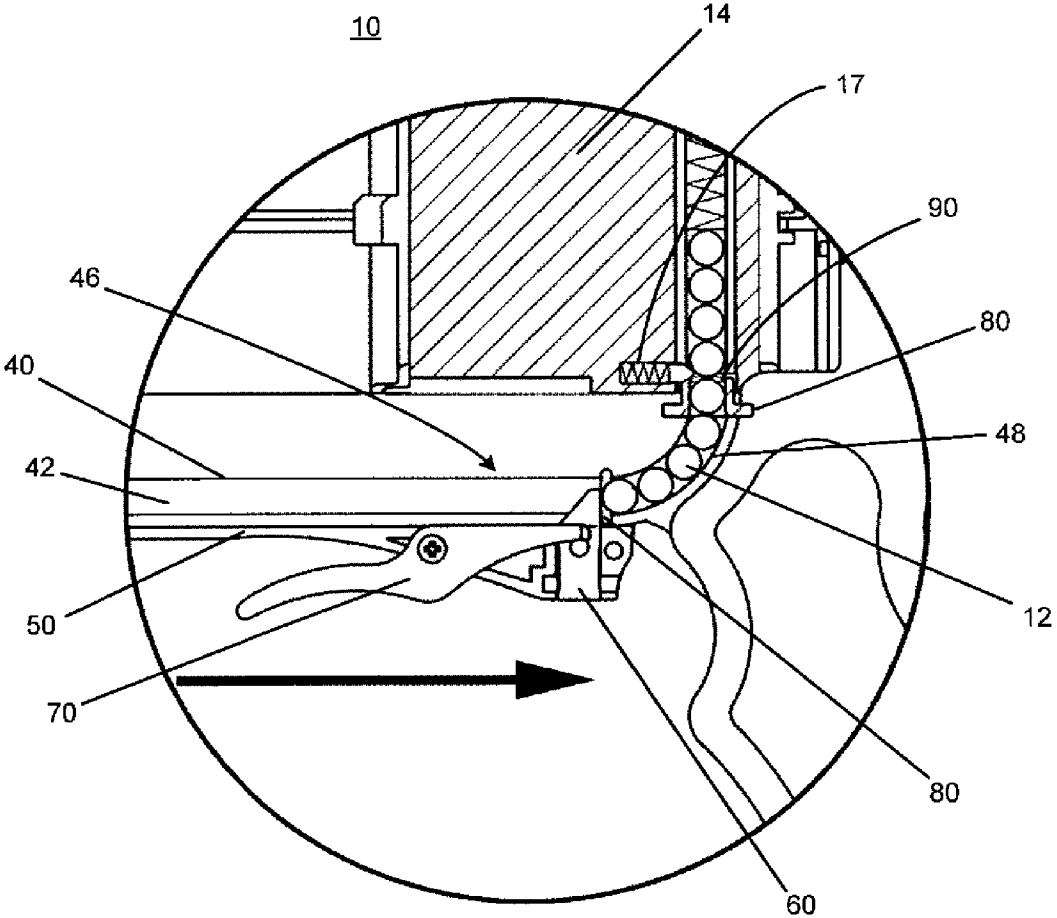
FIG. 6 is a cross-sectional illustration of the load pin, the second end of the load tube, and magazine of the ammunition loading apparatus of FIG. 1, in accordance with the first exemplary embodiment of the present disclosure.

A restrictive structure 80 may be positioned at the mouth 90 of the load tube 40 at the second end 46 to prevent the ammunition 12 from exiting the load tube 40 without a provoking force, as is discussed with respect to FIGS. 5-6. Other restrictive structures 80 may be used along any portion of the load tube 40 to control movement of the ammunition 12 within the load tube 40. For example, an additional restrictive structure 80 may be positioned proximate to a bend 48 in the load tube 40, such that the bend 48 is positioned between two restrictive structures 80. This design may be useful in retaining a quantity of ammunition 12 proximate to the mouth 90 of the load tube 40.

FIG. 2 is a cross-sectional illustration along the line A-A of the ammunition loading apparatus 10 of FIG. 1, in accordance with the first exemplary embodiment of the present disclosure. In particular, FIG. 2 clearly depicts the apparatus 10, having the rail system 52 for the pump device 50 (FIG. 1) positioned exteriorly, and a storage compartment 20, the preload chamber 30, and the stacking chamber 36 positioned interiorly. As the ammunition 12 within the storage chamber 20 is moved into the preload chamber 30, the preload chamber 30 may become filled with ammunition 12. The stacking chamber 36, which is integrally formed to the preload chamber 30, may receive a portion of the ammunition 12 within the preload chamber 30. It may be preferable for the stacking chamber 36 to be sized to house ammunition 12 in a single-width configuration, such that the individual ammunition 12 rounds are positioned single file. This single file positioning of the individual ammunition 12 rounds may provide enhanced movement of the ammunition 12 into the load tube 40 by funneling the ammunition 12 towards the opening of the load tube 40.

In funneling the ammunition 12 towards a single file orientation, the various ammunition 12 rounds will be less likely to experience disruptive contact between each other and cause a malfunction or jam at the first end 44 of the load tube 40. This is due to the lessened number of degrees of freedom that the individual ammunition 12 rounds can be moved in. For example, in the storage compartment 20, the ammunition 12 may be chaotic and disorganized. As the ammunition 12 is moved into the preload chamber 30, it is moved into a small space, thereby preventing the ammunition 12 from moving as much as it could in the storage compartment 20. Even further, as the ammunition 12 enters the stacking chamber 36, it is moved into a space with even fewer degrees of freedom, which further limits the movement of the ammunition 12. Ultimately, as the ammunition 12 exits the stacking chamber 36 and enters the load tube 40 (FIG. 1), it has only two degrees of freedom, i.e., along an axis parallel with the elongated load tube 40. If the ammunition 12 were to enter the load tube 40 directly from the storage compartment 20, the ammunition 12 would be crowded and eventually become jammed.

Figure 3:
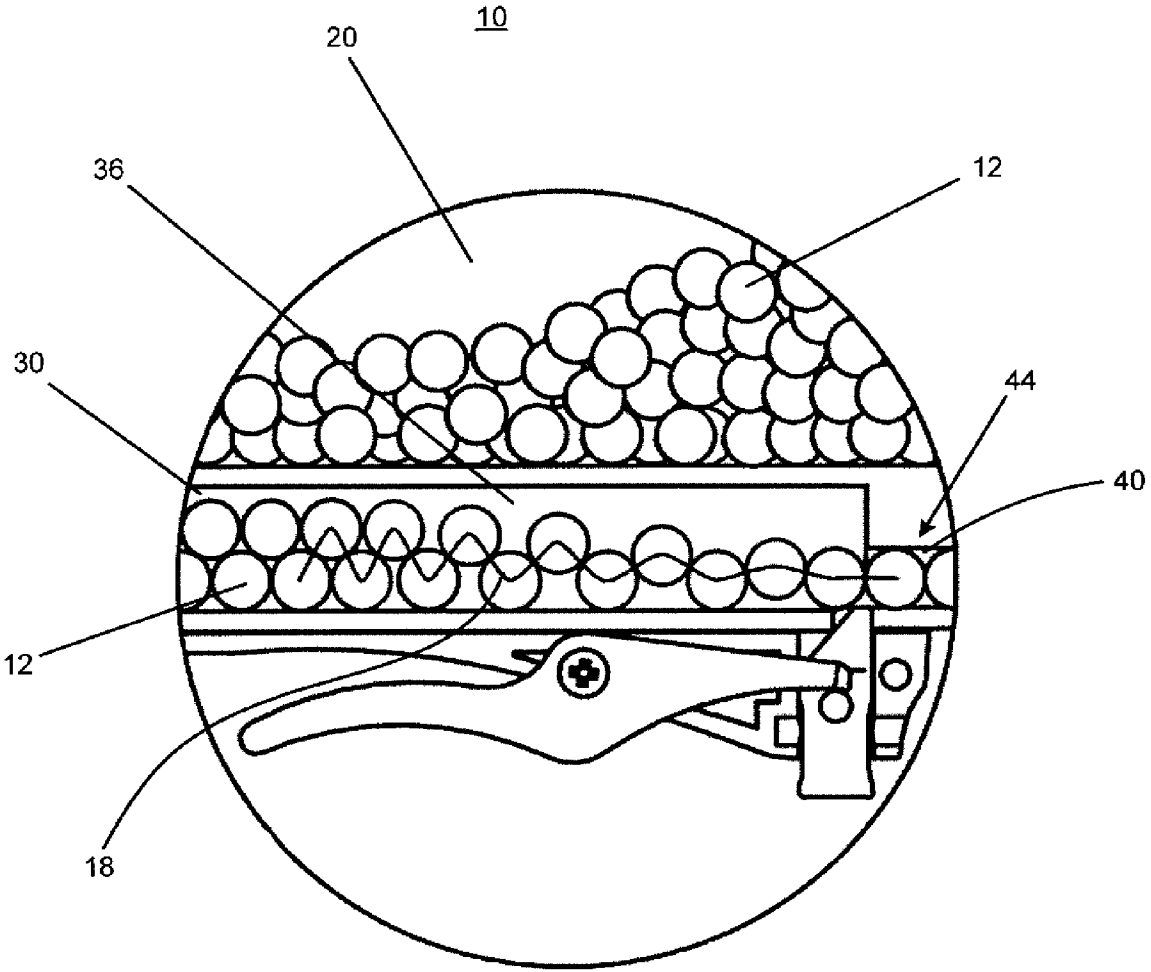
FIG. 3 is a cross-sectional illustration of the stacking chamber and load pin of the ammunition loading apparatus of FIG. 1, in accordance with the first exemplary embodiment of the present disclosure.

FIG. 3 is a cross-sectional illustration of the stacking chamber 36 and load pin 60 of the ammunition loading apparatus of FIG. 1, in accordance with the first exemplary embodiment of the present disclosure. As is best shown in FIG. 3, the ammunition 12 within the stacking chamber 36 may be positioned in a single file orientation for efficient loading of the ammunition 12 into the load tube 40. After the ammunition 12 is moved from the storage compartment 20 to the preload chamber 30, and into the stacking chamber 36, the individual ammunition 12 rounds may be positioned on top and below each other. In FIG. 3, a portion of the ammunition 12 rounds are identified with a height marker 18. The height marker 18 is a representative line drawn through the individual ammunition 12 rounds that identifies the center point of each ammunition 12 round. Naturally, when the height marker 18 is greatly varied, as is shown in the area of the stacking chamber 36 closest to the preload chamber 30, the ammunition 12 rounds are not positioned in a single file orientation. As the height marker 18 begins to level off, the positioning of the individual ammunition 12 rounds becomes closer to a single file orientation, and when the ammunition 12 rounds enter the load tube 40, they are in a single file orientation. The preload chamber 30 and stacking chamber 36 of the apparatus 10 transition the orientation of the ammunition 12 rounds from a jumbled, non-organized state in the storage compartment 20 to an organized, single file orientation within the first end 44 of the load tube 40.

Figure 4:
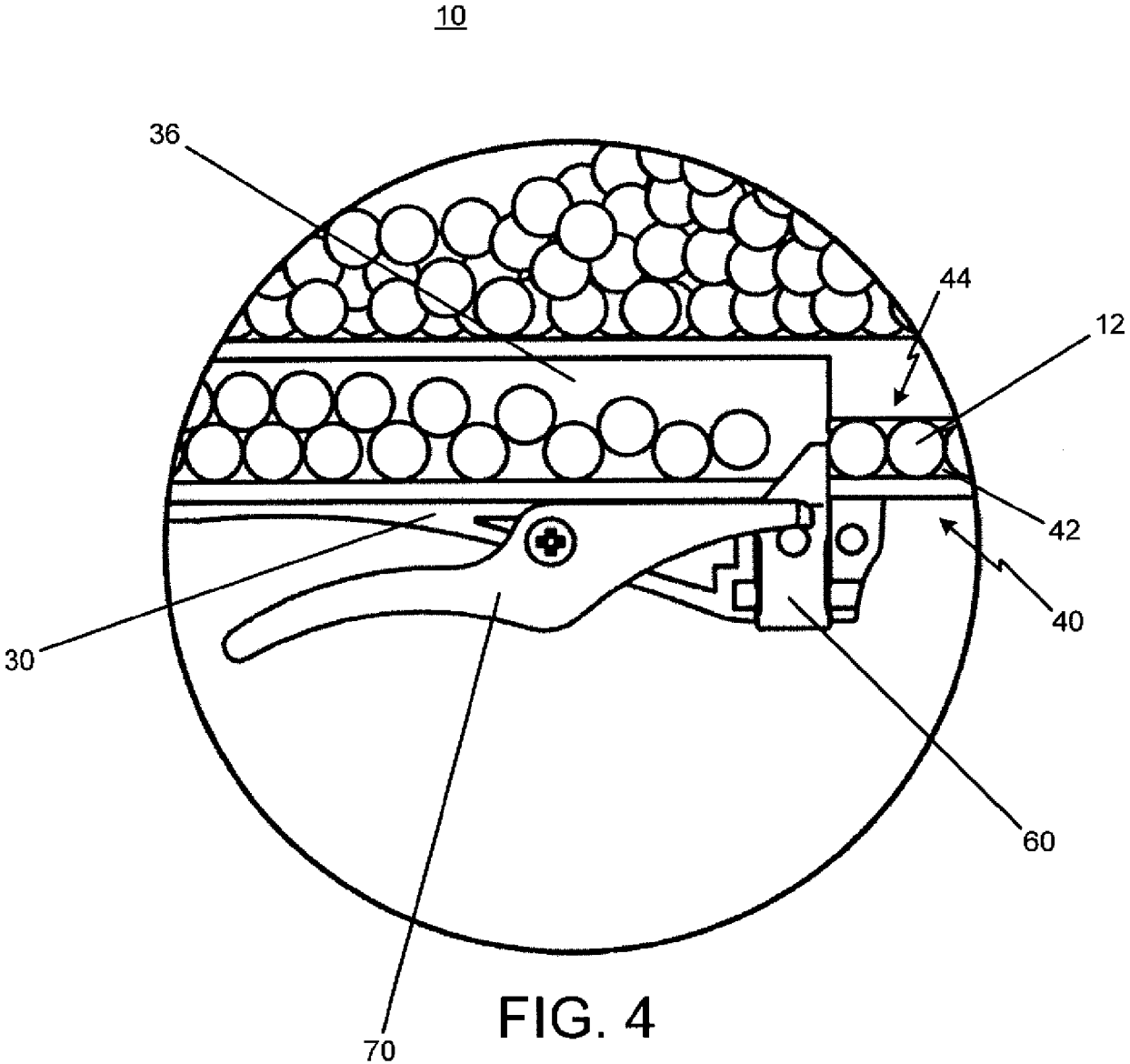
FIG. 4 is a cross-sectional illustration of the stacking chamber and load pin of the ammunition loading apparatus of FIG. 1, in accordance with the first exemplary embodiment of the present disclosure.

FIG. 4 is a cross-sectional illustration of the stacking chamber 36 and load pin 60 of the ammunition loading apparatus 10 of FIG. 1, in accordance with the first exemplary embodiment of the present disclosure. The transition of the orientation of the ammunition 12 described in FIG. 3 may greatly prevent jamming within the load tube 40, thereby allowing the load pin 60 actuated by the trigger 70 and movable with the pump device 50, to load the ammunition conveniently and efficiently into the magazine. Once a quantity of ammunition 12 is positioned within the load tube 40, the load pin 60 may be placed in the intersecting position with the ammunition passageway 42 to prevent the ammunition 12 within the load tube 40 from moving back into the stacking chamber 36, and to prevent additional ammunition 12 within the stacking chamber 36 from entering the load tube 40. In this position, the user may move the pump device 50 to move the ammunition 12 within the load tube 40, down the ammunition passageway 42, through the restrictive structures 80, and into the magazine 14.

FIG. 5 is a cross-sectional illustration of the second end 46 of the load tube 40 of the ammunition loading apparatus 10 of FIG. 1, in accordance with the first exemplary embodiment of the present disclosure. As is shown in FIG. 5, the ammunition 12 within the ammunition passageway 42 of the load tube 40 occupies the second end 46 of the load tube 46, proximate to the magazine 14. The magazine 14 is in an engaged position on the apparatus 10, such that it is positioned to receive the ammunition 12 from the mouth 90 of the load tube 40. The load tube 40 may have a bend 48 to that directs the ammunition 12 towards the magazine 14, and the bend 48 may be flanked by restrictive structures 80, as is shown, to keep a plurality of ammunition 12 rounds within that portion of the load tube 40. This configuration may be useful in preventing the ammunition 12 from moving within the load tube 40 towards the preload chamber 30.

The magazine 14 may have a retaining clip 17, which is a biased structure that prevents ammunition 12 from exiting the magazine 14 once the ammunition 12 is located therein. The combination of the restrictive structure 80 at the mouth 90 of the second end 46 of the load tube 40 and the retaining clip 17 of the magazine 14 may prevent ammunition 12 from being lost during a loading procedure. For example, as ammunition 12 is loaded into the magazine 14, it is pushed through the bend 48 in the load tube 40, through the restrictive structures 80, and past the retaining clip 17 of the magazine 15. The force pushing the ammunition 12 down the load tube 40 may be great enough to overcome the resistance of the restrictive structures 80 and resistance of the retaining clip 17, or springs within the magazine 14.

Once the magazine 14 is full, it may be removed and replaced with an additional magazine 14. As the magazine 14 is removed from the mouth 90 of the load tube 40, the restrictive structure 80 at the mouth 90 of the load tube 40 may prevent any ammunition 12 proximate to the mouth 90 from inadvertently falling out of the load tube 40. At the same time, the retaining clip 17 of the magazine 14 may prevent any of the loaded ammunition 12 from escaping from the magazine 14. Thus, the apparatus 10 provides from a loading operation that prevents ammunition 12 rounds from being inadvertently dropped, or otherwise wasted.

FIG. 6 is a cross-sectional illustration of the load pin 60, the second end 46 of the load tube 40, and magazine 14 of the ammunition loading apparatus of FIG. 1, in accordance with the first exemplary embodiment of the present disclosure. In particular, FIG. 6 illustrates the load pin 60 and pump device 50 positioned at the second end 46 of the load tube 40, after a quantity of ammunition 12 within the load tube 40 has been loaded into the magazine. As is shown, the load pin 60 may traverse up the load tube 40 until it reaches the restrictive structure 80 at the bend 48. The ammunition 12 moves through the restrictive structures 80 and enters the magazine 14, moving past the retaining clip 17. The portion of ammunition 12 between the restrictive structures 80, i.e., the restrictive structures 80 located on either sides of the bend 48, may be retained therein. The pump device 50 may then be moved forward towards the front of the apparatus 10, where another quantity of ammunition 12 is loaded into the load tube 40 via actuation of the trigger 70, as described previously.

Figure 7:
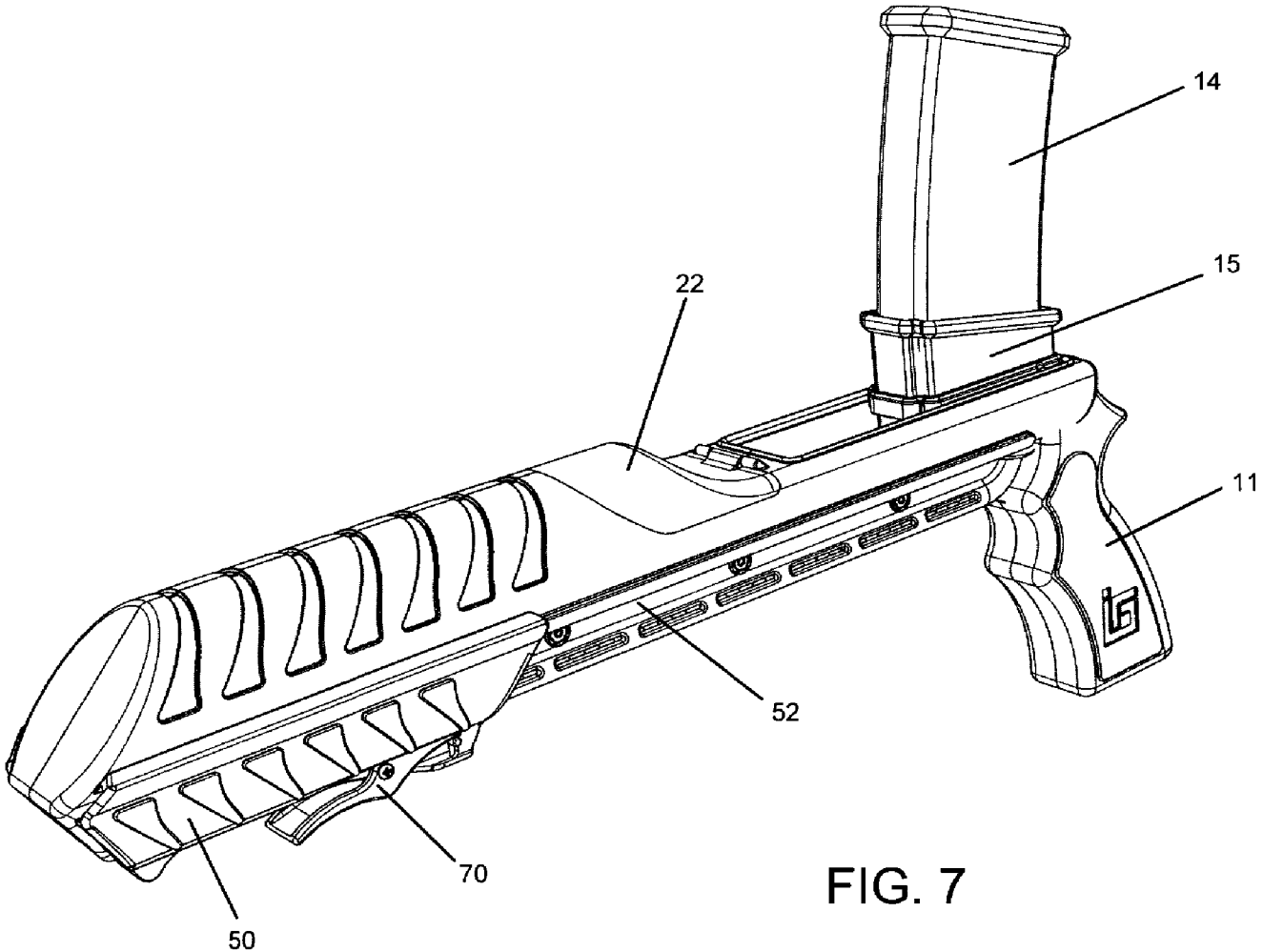
FIG. 7 is a plan view illustration of the ammunition loading apparatus of FIG. 1, in accordance with the first exemplary embodiment of the present disclosure.

FIG. 7 is a plan view illustration of the ammunition loading apparatus 10 of FIG. 1, in accordance with the first exemplary embodiment of the present disclosure. As can be seen in FIG. 7, the apparatus 10 may have a design that provides for ergonomic use. This may include a grip 11 positioned on one side of the apparatus 10, which the user can grasp to secure the apparatus 10 during movement of the pump device 50. FIG. 7 also clearly depicts the rail system 52 positioned on the exterior of the apparatus 10 which the pump device 50 may ride on. The trigger 70 may be located beneath the pump device 50 to allow a user to actuate the trigger 70 with one hand while holding the apparatus 10 on the grip 11 with the other hand. Likewise, the user may hold the apparatus 10 with the grip 11 to move the lid 22 and fill the storage compartment with ammunition, or to engage or disengage the magazine 14 or magazine adapter 15.

Figure 8:
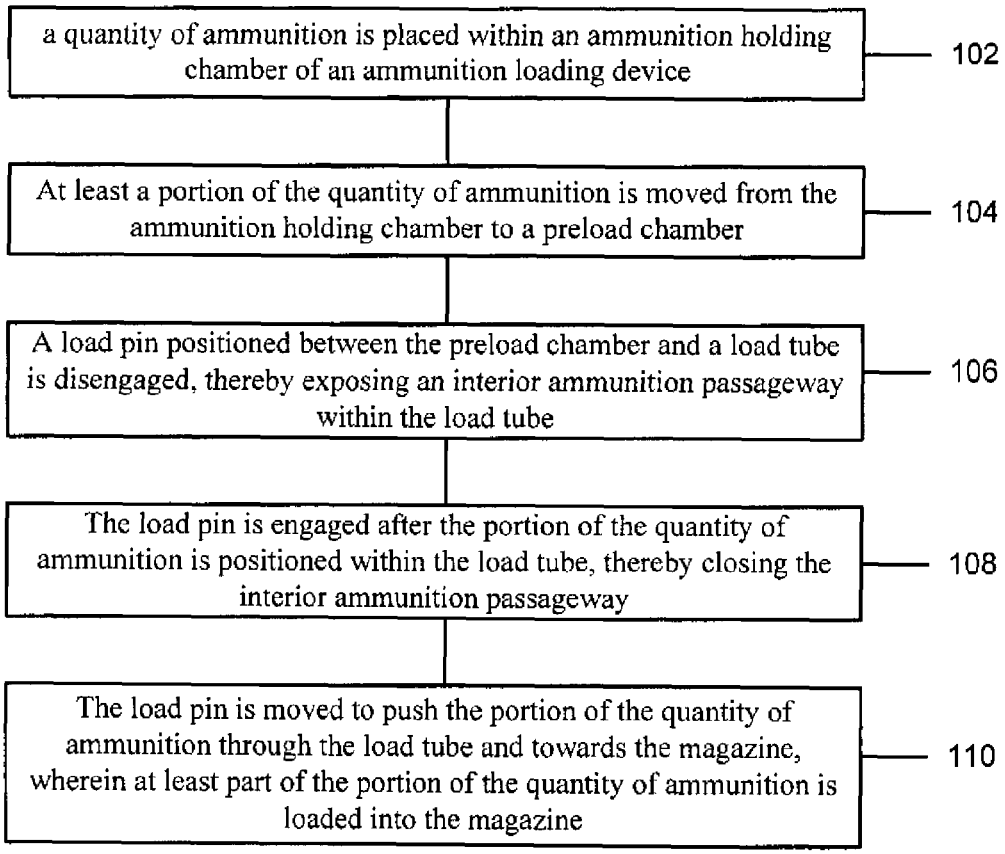
FIG. 8 is a flowchart illustrating a method of loading a magazine with ammunition, in accordance with the first exemplary embodiment of the present disclosure.

FIG. 8 is a flowchart 100 illustrating a method of loading a magazine with ammunition, in accordance with the first exemplary embodiment of the present disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, a quantity of ammunition is placed within an ammunition holding chamber of an ammunition loading device. At least a portion of the quantity of ammunition is moved from the ammunition holding chamber to a preload chamber (Block 104). A load pin positioned between the preload chamber and a load tube is disengaged, thereby exposing an interior ammunition passageway within the load tube (Block 106). The load pin is engaged after the portion of the quantity of ammunition is positioned within the load tube, thereby closing the interior ammunition passageway (Block 108). The load pin is moved to push the portion of the quantity of ammunition through the load tube and towards the magazine, wherein at least part of the portion of the quantity of ammunition is loaded into the magazine (Block 110).

The method may include any additional number of steps, or variations of steps, including any of the functions, structures, features, or actions disclosed with respect to FIGS. 1-7. For example, the method may include the step of rocking the ammunition loading device back and forth to move the portion of the quantity of ammunition from the ammunition holding chamber and into the preload chamber. This action may move the ammunition within the ammunition holding chamber over a baffle positioned between the ammunition holding chamber and the preload chamber. Similarly, the ammunition may be moved from the preload chamber to a stacking chamber that is sized to house the portion of the quantity of ammunition in a single-width configuration, such that the ammunition has a linear, single-file orientation. Then, the ammunition may be moved through the interior ammunition passageway and into the load tube. Movement of the pump device and the load pin may force the portion the ammunition through a restrictive structure positioned at a mouth of the load tube at the second end, between the load tube and the magazine.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An ammunition loading apparatus comprising:

a storage compartment;

a preload chamber connected to the storage compartment;

a stacking chamber having an elongated U-shaped channel, the stacking chamber connected to a bottom of the preload chamber along a length of the U-shaped channel, wherein an elongated top opening of the U-shaped channel is formed between the preload chamber and the stacking chamber, the elongated top opening of the U-shaped channel having a length that exceeds a width thereof, wherein the length of the elongated top opening of the U-shaped channel is sized to permit at least two ammunitions of a quantity of ammunition to pass therethrough concurrently;

a load tube sized to receive the quantity of ammunition within an interior ammunition passageway, the load tube having a first end and a second end, wherein the first end is connected to the stacking chamber;

a magazine removably connectable to the second end of the load tube;

a pump device movable along at least a portion of a length of the load tube; and a load pin connected to the pump device and movably controlled by the pump device along the portion of the length, of the load tube, wherein the load pin is further movable between at least a first position intersecting the interior ammunition passageway and a second position not intersecting the interior ammunition passageway.

2. The ammunition loading apparatus of claim 1, wherein a width dimension of the elongated top opening of U-shaped channel of the stacking chamber is sized permit no more than one ammunition of the quantity of ammunition to pass therethrough concurrently.

3. The ammunition loading apparatus of claim 1, wherein the U-shaped channel of the stacking chamber is sized to house the quantity of ammunition in a single-width, dual-high configuration.

4. The ammunition loading apparatus of claim 1, wherein the load pin in a first position is located intersecting an ammunition path between the first end of the load tube and the stacking chamber, wherein the load pin separates the stacking chamber from the interior ammunition passageway of the load tube.

5. The ammunition loading apparatus of claim 4, wherein the load pin in a second position is not intersecting the ammunition path, wherein the ammunition path from the stacking chamber to the interior ammunition passageway within the load tube is unobstructed.

6. The ammunition loading apparatus of claim 5, further comprising an actuatable trigger connected to the load pin, wherein actuation of the trigger moves the load pin between the first and second positions.

7. The ammunition loading apparatus of claim 1, further comprising a lid movably connected to the storage compartment, wherein the lid controls access to the storage compartment.

8. The ammunition loading apparatus of claim 1, further comprising a baffle positioned between the storage compartment and the preload chamber, wherein the baffle is slanted upwards to a location between the storage compartment and the preload chamber.

9. The ammunition loading apparatus of claim 1, wherein the second end of the load tube further comprises at least one restrictive structure, wherein the at least one restrictive structure is sized to frictionally impede movement of the quantity of ammunition beyond the second end of the load tube.

10. The ammunition loading apparatus of claim 9, wherein the at least one restrictive structure is positioned at a mouth of the load tube at the second end.

11. The ammunition loading apparatus of claim 9, further comprising two restrictive structures positioned along the load tube, wherein a bend in the load tube is located between the two restrictive structures.

12. The ammunition loading apparatus of claim 9, wherein the at least one restrictive structure further comprises at least one of an O-ring and a feed nozzle.

13. An apparatus for loading a quantity of spherically-shaped ammunition into a magazine, the apparatus comprising:

an ammunition holding chamber;

a load tube connected between the ammunition holding chamber and a magazine, wherein an elongated slot is formed within at least a portion of a wall of the load tube, wherein the elongated slot is positioned substantially parallel with a length the load tube, and wherein the load tube sized to house the quantity of spherically-shaped ammunition in a linear configuration within an interior ammunition passageway; and a loading device having a pump handle and a load pin, wherein the loading device is movable along at least a portion of a length of the load tube with the load pin positioned within the elongated slot, wherein movement of the load pin along the elongated slot loads the quantity of spherically-shaped ammunition into the magazine through the load tube, wherein the load pin is further movable between at least a first position intersecting the interior ammunition passageway and a second position not intersecting the interior ammunition passageway.

14. The ammunition loading apparatus of claim 13, further comprising a restrictive structure positioned at a mouth of the load tube, between the load tube and the magazine.

15. The ammunition loading apparatus of claim 1, further comprising a baffle positioned between the storage compartment and the preload chamber, wherein the baffle has a free end extending to a location between the storage compartment and the preload chamber.

16. The ammunition loading apparatus of claim 8, wherein a first portion of the quantity of ammunition in the storage compartment is positioned on a first side of the baffle and a second portion of the quantity of ammunition in the preload chamber is positioned on a second side of the baffle, wherein the first side is opposite the second side.

17. The ammunition loading apparatus of claim 1, wherein a plane of the elongated top opening of the U-shaped channel is positioned substantially parallel with a length of the load tube.

18. The ammunition loading apparatus of claim 6, wherein movement of the load pin between the first and second positions further comprises movement of the load pin in a direction substantially perpendicular to the length of the load tube.

19. The apparatus for loading a quantity of spherically-shaped ammunition into a magazine of claim 13, further comprising an actuatable trigger connected to the load pin, wherein the actuatable trigger controls a movement of the load pin in a direction substantially perpendicular to the length of the load tube.

20. An apparatus for loading a quantity of spherically-shaped ammunition pellets into a magazine, the apparatus comprising:

an ammunition holding chamber;

an ammunition stacking channel connected to the ammunition holding chamber, wherein the ammunition stacking channel comprising an elongated opening with the ammunition holding chamber, wherein the elongated opening is sized to receive at least two spherically-shape ammunition pellets concurrently;

a load tube sized to receive a quantity of spherically-shape ammunition pellets within an interior ammunition passageway connected between the ammunition stacking chamber and the magazine; and a loading device having a pump handle and a load pin, wherein the loading device is movable along at least a portion of a length of the load tube, wherein the load pin is further movable between at least a first position intersecting the interior ammunition passageway and a second position not intersecting the interior ammunition passageway.

* * * * *